US005326435A

United States Patent [19]

Hirsimäki et al.

[11] Patent Number: 5,326,435

[45] Date of Patent: Jul. 5, 1994

[54] METHOD AND DEVICE IN A CRAWLING OPERATION OF A PRESS FELT IN A PAPER MACHINE

[75] Inventors: Martti Hirsimäki, Jyskä, Finland; Jouko Villa, Appleton, Wis.; Lauri Suvanto, Jyväskylä , Finland

[73] Assignee: Valmet Paper Machinery Inc., Finland

[21] Appl. No.: 20,139

[22] Filed: Feb. 19, 1993

[30] Foreign Application Priority Data

Feb. 20, 1992 [FI] Finland ..... 920746

[51] Int. Cl.[5] ..... D21F 1/32

[52] U.S. Cl. ..... 162/199; 162/274; 162/358.1; 162/272; 100/151

[58] Field of Search ..... 226/37, 188, 179; 100/172, 151; 72/239; 162/199, 274, 358.1, 272

[56] References Cited

U.S. PATENT DOCUMENTS 4,452,668 6/1984 Vallius et al. ..... 162/199

FOREIGN PATENT DOCUMENTS 3506155 6/1986 Fed. Rep. of Germany .
4004726 8/1990 Fed. Rep. of Germany .
9109312 9/1991 Fed. Rep. of Germany .

*Primary Examiner*—W. Gary Jones
*Assistant Examiner*—Brenda Adele Lamb
*Attorney, Agent, or Firm*—Steinberg, Raskin & Davidson

[57] ABSTRACT

The invention relates to a method and device in the crawling operation of a press felt in a paper machine. The press felt is passed as a closed felt loop through a nip defined between a center roll and a press roll in a press section of the paper machine. The felt is driven during the running operation of the paper machine by means of a nip drive between the center roll and the press roll of the press. When the paper machine is not operating, and the nip between the center roll and the press roll in the paper machine is open, the felt is moved, so as to moisten the new felt, by means of the crawling drive by rotating the drive roll. An axle of the drive roll is permanently connected to a drive rim. During the crawling operation, a drive wheel of a hydraulic device is brought into engagement with the drive rim. When the crawling drive of the felt is not in operation, the drive roll is switched to the free revolving position by shifting the drive wheel of the hydraulic device apart from the drive rim. The drive wheel is operationally connected to the drive rim.

7 Claims, 4 Drawing Sheets

METHOD AND DEVICE IN A CRAWLING OPERATION OF A PRESS FELT IN A PAPER MACHINE

BACKGROUND OF THE INVENTION

The invention relates to a method and device in a crawling operation of a press felt in a paper machine. In the paper machine, the press felt is passed as a closed loop through a press nip defined between a center roll and a press roll. The drive of the felt is produced by means of a nip drive during a running operation of the paper machine.

When replacing the press felt and installing a new felt, the new felt is advantageously moistened before starting the operation of the paper machine. In this felt-moistening stage, the felt is driven with a low crawling speed by means of a separate drive gear while the press nip is open.

In prior art devices, the drive gear consists of an electric motor whose speed of rotation is lowered by means of a reduction gear. An output shaft of the reduction gear is connected to a mechanical cylinder-operated coupling. The rotational movement of the output shaft is transferred through the coupling to an axle of a drive roll of the felt. The drive gear is connected to the drive roll in order to cause the drive roll to revolve and thus turn the felt so that it can be moistened.

The device described above has been formed by coupling the constructional units of the mechanism one after the other. However, in this manner, the length of the device becomes detrimentally long. Further, the device consists of a number of individual components each one of which has a certain rate of failure. For this reason, the susceptibility of failure of the complete operating mechanism of the device is relatively high.

In the cylinder operation of the coupling, separate limit detectors have been used. By using these detectors in the prior art devices, the main drive of the felt is prevented from switching on in situations where the auxiliary drive, i.e. The nip drive, is still in operation. However, it is a significant drawback that the detectors are susceptible to contamination, in which case the data on limit positions given by the detectors has not always been reliable.

OBJECTS AND SUMMARY OF THE INVENTION

Accordingly, it is an object of the present invention to provide a new and improved method and device for use in the crawling operation of a press felt in which the drawbacks of the prior art devices are eliminated.

It is another object of the present invention to provide a new and improved method and device for use in the crawling operation of a press felt in which a coupling and drive gear are arranged in the same unit. In this regard, the device used in the method in accordance with the present invention does not comprise a separate disconnecting coupling, a separate gearbox, or a separate drive unit, but these consist of one unit. Thus, it has been possible to make the whole drive unit of simple construction and relatively short length.

It is yet another object of the present invention to provide and new and improved method and device for the crawling operation of a press felt in which the operation is more reliable than prior art devices and methods. This is achieved because the rate of failure of the device and method in accordance with the present invention is lower than in prior art devices and methods as there are fewer operational units susceptible of failure. Thus, the operation of the equipment is considerably more reliable than prior art electro-mechanical crawling-drive systems.

In the method in accordance with the invention for crawling operation of a press felt, there are two different stages of operation of the paper machine. When the paper machine is not operating, the nip between the center roll and the press roll in the paper machine is open. In this mode, the felt is moved, e.g., so as to moisten the new felt, by means of the crawling drive by rotating a drive roll. In this manner, a new press felt is moisten before restarting the paper machine. In the crawling operation when the press felt is being moistened, a drive wheel of a hydraulic device is brought into engagement with a drive rim which is connected to an axle of the drive roll. In this manner, both the drive rim and drive roll will revolve.

In the second stage, when the paper machine is operating and the crawling drive of the felt is not in operation, the drive roll is switched to a free revolving position by shifting the drive wheel of the hydraulic device apart from the drive rim. Thus, the drive wheel is operationally connected with the drive rim only during the crawling operation.

In the device in accordance with the invention, a hydraulically displaceable drive wheel is operationally connected with the drive rim and at least one spring. In order to effect the position of free rotation of the drive roll of the felt, the spring is arranged to maintain the drive wheel apart from the drive rim during the running operation of the paper machine. During the crawling operation, the drive wheel engages the drive rim and drives the drive roll to rotate. The arrangement of the device operates both as means of rotation of the drive rim and also as a coupling device for the drive roll for the crawling operation of the felt.

BRIEF DESCRIPTION OF THE DRAWINGS

The following drawings are illustrative of embodiments of the invention and are not meant to limit the scope of the invention as encompassed by the claims.

FIG. 3B shows the device of FIG. 3A in a position of free rotation wherein the main drive of the press felt may be switched on.

DETAILED DESCRIPTION OF THE INVENTION

Figure 1A:
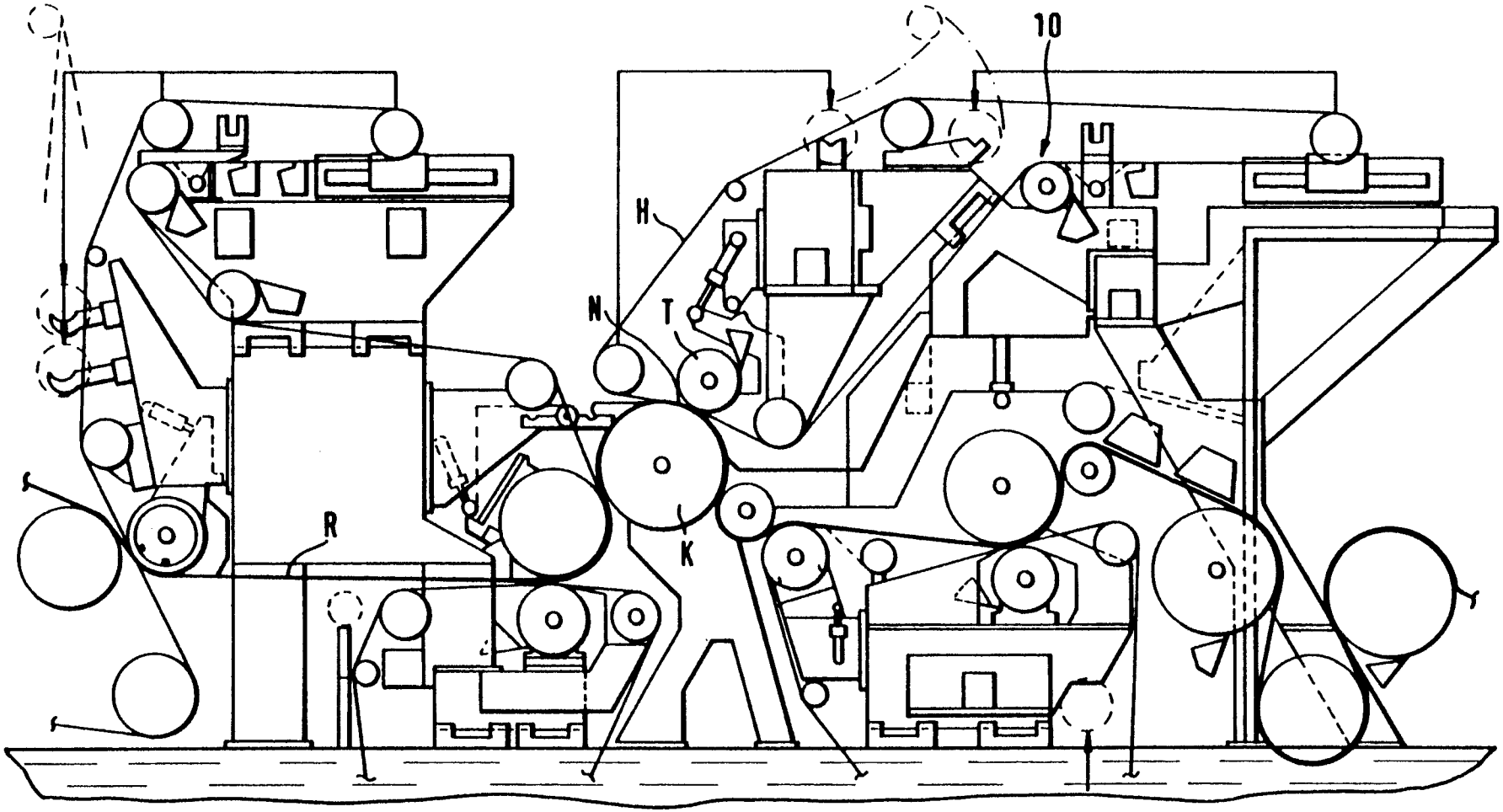
FIG. 1A shows a position of the device of the present invention in a paper machine as used in the method in accordance with the present invention.

FIG. 1A shows the location and position of a crawling-drive roll 10 of a press felt H in a press section of a paper-making machine. A nip N is defined between a center roll K and a roll T in the paper machine. When nip N is open, the press felt is operated by means of the drive roll 10. The press felt may be operated in order to moisten the felt before a new felt is run through the paper machine. The roll 10 is a so-called crawling-drive roll. During operation of the paper machine, the felt is operated and driven by means of the nip N and, in such a situation, the roll 10 is in a position of free rotation in order to reduce resistance.

Figure 1B:
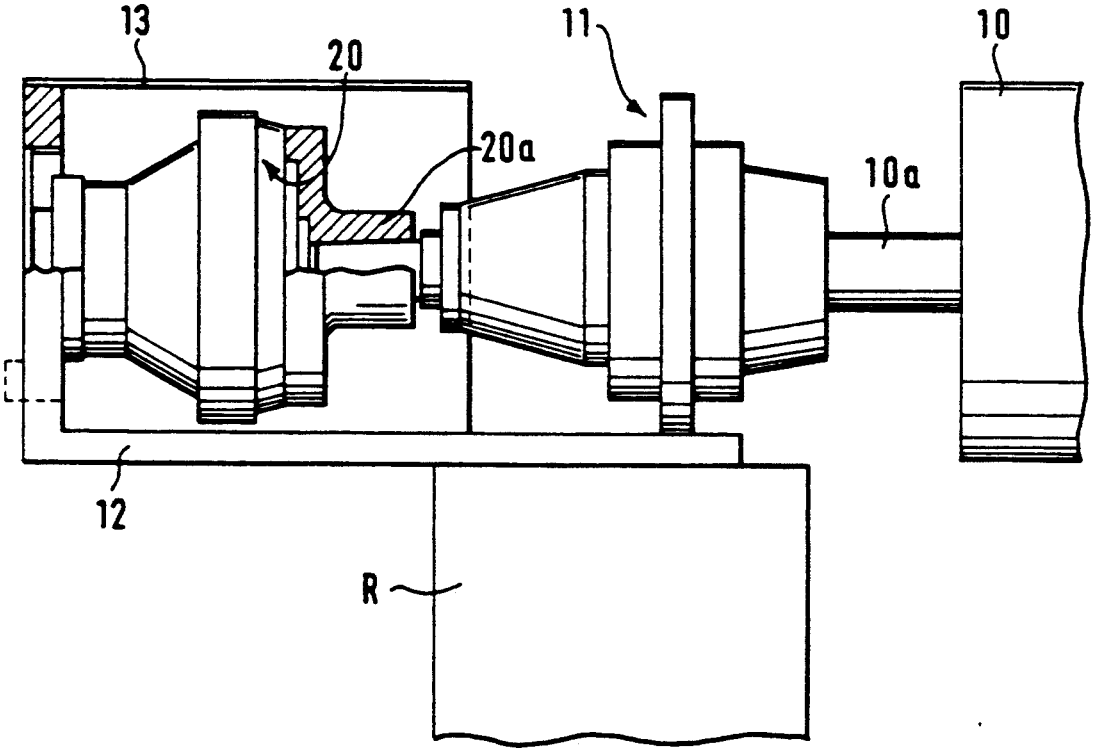
FIG. 1B shows a device in accordance with the invention, and used in the method in accordance with the invention, for the crawling operation of a press felt as viewed in a machine direction.

FIG. 1B shows the crawling-drive device of the press felt as viewed in the machine direction. The press felt H is operated and driven by the press-felt drive roll 10 whose axle 10*a* is mounted in bearings 11. The drive roll 10 receives its rotation drive directly from a drive rim 20 whose body 20*a* is connected to the axle 10*a* of the roll 10. A protective housing 13 is arranged around the device. The device rests on a cantilevered frame beam 12 which is attached to a frame R. The drive rim may also be directly connected to the drive roll itself.

Figure 2:
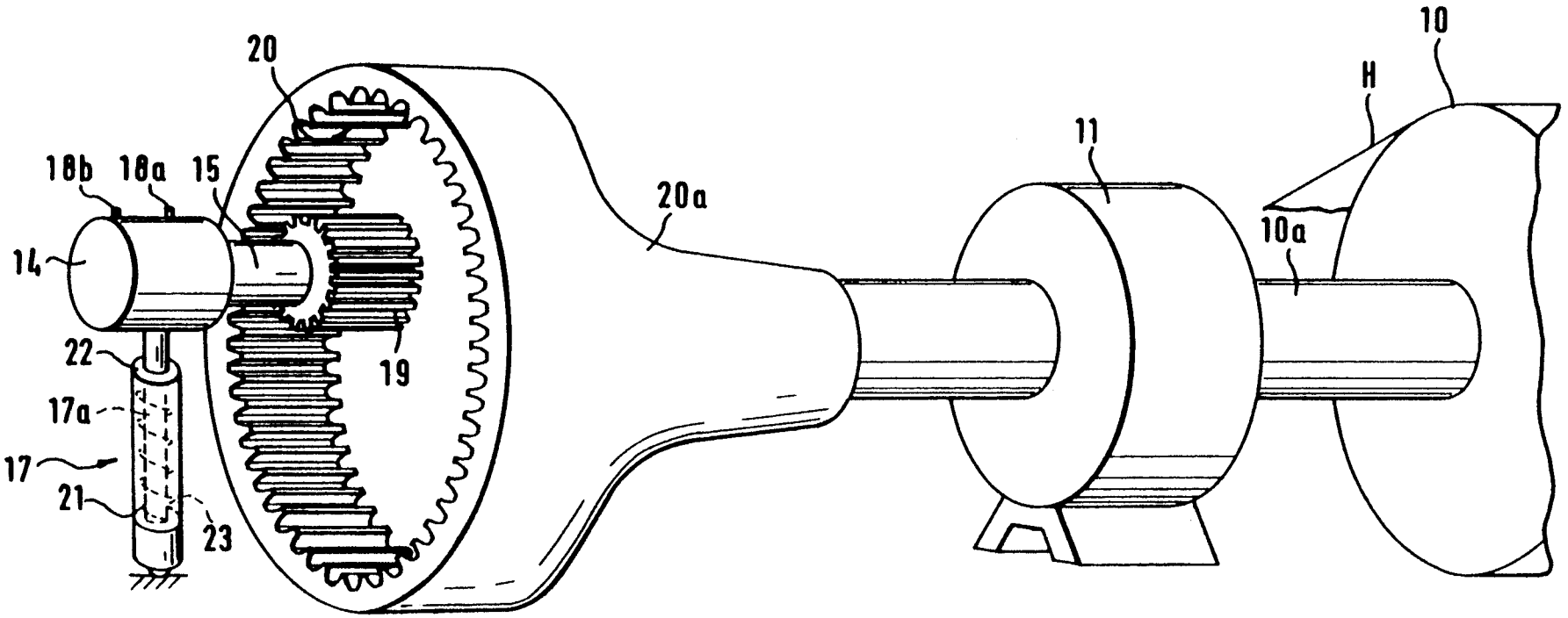
FIG. 2 shows another embodiment of the device used in the method in accordance with the present invention, wherein a hydraulic mechanism is displaced hydraulically so that a drive wheel is brought into contact with a drive rim.

FIG. 2 shows an embodiment of the crawling-drive device in accordance with the invention. An output or drive shaft 15 of a hydraulic motor 14 is connected with a drive wheel 19. The hydraulic motor 14 is provided with an input connection 18*a* and an output connection 18*b* for fluid. The hydraulic motor 14 is displaced by means of a cylinder device 17, preferably by means of a hydraulic cylinder or possibly an actuator. The motor 14 is displaced toward the drive rim 20 by an extension of the cylinder device 17. A drive wheel 19 is arranged on the output shaft 15 of the hydraulic motor 14.

In use, when the hydraulic cylinder 14 is extended to its full stroke length, in the way shown in FIG. 2, the drive wheel 19 is brought into engagement with the drive rim 20. The drive wheel 19 is preferably a cog-wheel whereas the drive rim 20 is preferably a toothed rim. In this situation, when the drive wheel 19 rotates, the drive rim 20 will also rotate in a corresponding manner to turn the drive roll 10. In a preferred embodiment, the teeth of the toothed rim of the drive rim 20 are aligned to engage with the teeth of the drive wheel 19.

When the pressure in the hydraulic cylinder 17 is released and removed, a spring 23, which is arranged between a piston 21 of the hydraulic cylinder 17 and cylinder end 22, shifts the motor 14, and hence the drive wheel 19 out of contact with the drive rim 20. Thus, the arrangement operates both as a drive gear for the roll 10 and as an over-running clutch.

When the crawling operation of the felt H is not operating (the paper machine is in the running operation), the spring 23 shifts the drive wheel 19 out of contact with the drive rim 20, in which case the drive roll 10 is in the position of free rotation. The position of free rotation of the drive roll 10 is desired when the felt is being driven by the press nip N so that a minimum resistance of the drive roll 10 is obtained.

Figure 3A:
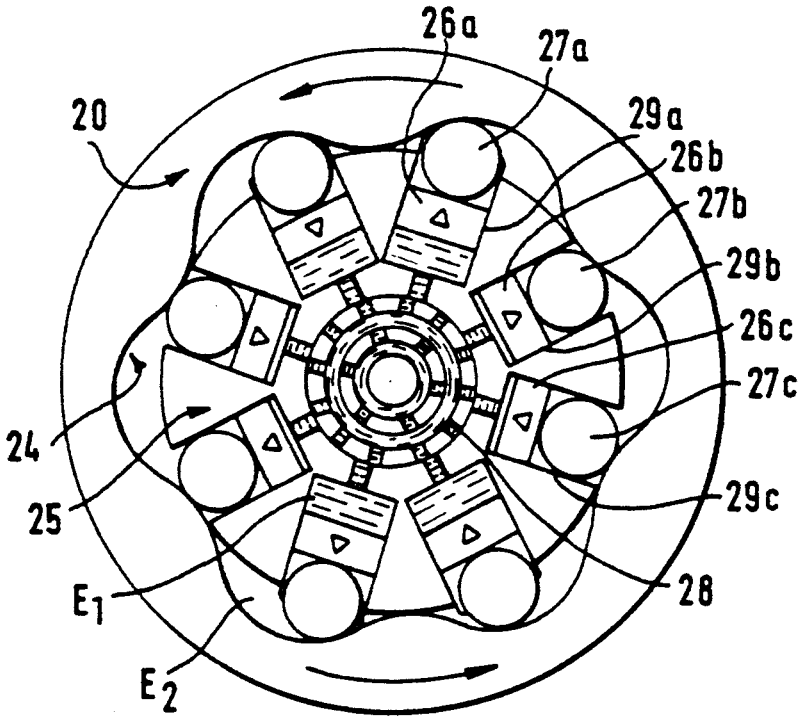
FIG. 3A shows still another embodiment of the device in accordance with the invention, and used in the method in accordance with invention, wherein a drive rim is rotated by means of a cam mechanism.

FIG. 3A shows another embodiment of the crawling-drive device in accordance with the present invention and used in the method of the present invention. In this embodiment, the drive rim 20 comprises a wave-shaped inside rim form 24. Inside the drive rim 20, a drive unit 25 is arranged. The drive unit 25 comprises a number of cylinders 29*a*,29*b*, . . . in which drive pistons 26*a*,26*b*. . . , and cam-wheels 27*a*,27*b*. . . are arranged, respectively, in each of the cylinders. The cam wheels are preferably arranged at an end of the drive pistons.

The rotational movement of the drive rim 20 is produced by passing pressurized fluid through an inlet opening of a distributor 28 and from the distributor 28 further into the cylinders 29*a*,29*b* . . . The distributor 28 revolves synchronously with the drive rim 20. Some of the drive pistons 26*a*,26*b* . . . are in the work stage, i.e. operating, and push the respective cam-wheels 27*a*,27*b* . . . against the drive rim 20. The cam-wheels 27*a*,27*b* . . . that are in the work stage force the drive rim 20 into a revolving motion by applying pressure against the drive rim 20.

After the pistons 26*a*,26*b*. . . have performed their full stroke, the distributor 28 closes the inlet of fluid into the piston 26*a*, 26*b*, . . . that has completed its work stage and opens the exhaust opening to the fluid space of that piston. In a corresponding manner, the distributor 28 opens the flow passage for the pressurized fluid into the piston 26*a*,26*b*, . . . that is in the bottom position in its cylinder. In this manner, the pistons are alternating receiving and flushing pressurized fluid to the distributor 28.

Figure 3B:
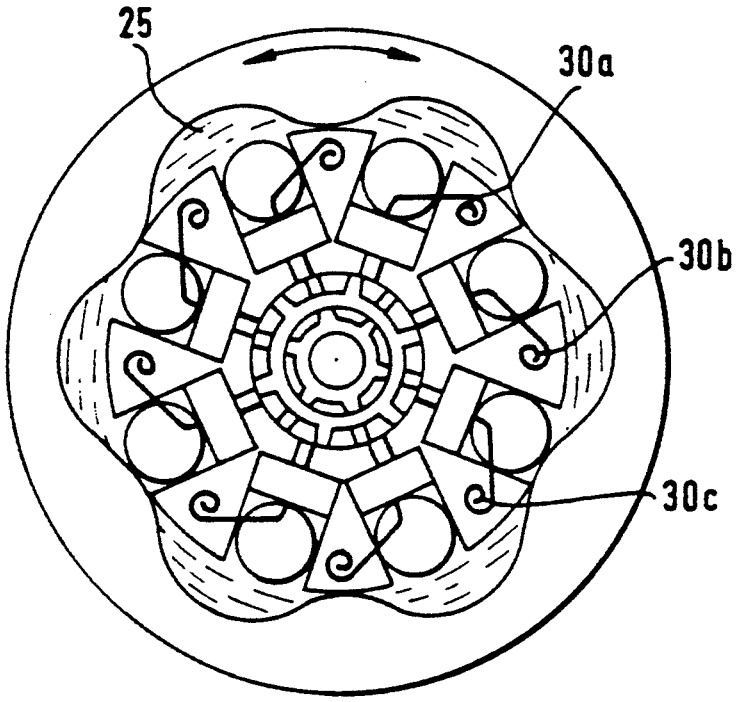

Referring to FIG. 3B, when pressurized fluid is not passed to the distributor 28 and, thereafter through the distributor into the pistons 26*a*,26*b*. . . , springs 30*a*,30*b*. . . press the pistons 26*a*,26*b*. . . into a bottom position in the cylinders 29*a*,29*b*,. . . In such a bottom position, the pistons do not interfere with the free rotation of the drive rim. In addition, springs 30*a*,30*b*, . . . keep the cam wheels 27*a*,27*b*, . . . placed at the ends of the pistons 26*a*,26*b*. . . apart from the drive rim 20. In such a case, the drive rim 20 can be rotated freely so that the system does not cause an operating resistance to the movement of rotation.

The cam mechanism permits a drive system in which the drive device and the disengaging coupling constitute a single unit. When the press felt H is switched to the main drive, fluid spaces $E_1$, $E_2$ arranged at both sides of the pistons 26*a*,26*b*. . . are kept free of pressure. In such a case, the springs 30*a*,30*b*. . . press the pistons 26*a*,26*b*. . . to their bottom positions in the respective cylinders 29*a*,29*b*. . . and keep them in place.

The press-felt H crawling-drive roll 10 is permanently connected to the rim 20 by means of the body 20*a*. The drive rim 20 and the crawling drive roll 10 can revolve freely at a high speed of rotation during normal operation of the paper machine while the felt H is driven by means of the nip N between the center roll K and the press roll T in the press.

The examples provided above are not meant to be exclusive. Many other variations of the present invention would be obvious to those skilled in the art, and are contemplated to be within the scope of the appended claims.

We claim:

1. A method in a crawling operation of a press felt in a paper machine, comprising forming a nip between a center roll and a press roll in the paper machine, passing the press felt as a closed felt loop through the nip, arranging a drive roll such that the felt runs over the drive roll, said drive roll having a free revolving position during a running operation of the paper machine, connecting an axle of the drive roll to a drive rim such that a rotation of the drive rim will cause a rotation of the drive roll, engaging drive means with the drive rim to provide the crawling operation of the drive roll to move the felt when the paper machine is not in the running operation, and switching the drive roll to the free revolving position when the paper machine is in the running operation by separating the drive means from the drive rim.

2. The method of claim 1, further comprising providing the drive means as a displaceable drive wheel of a hydraulic device, engaging the drive wheel with the drive rim such that the drive wheel contacts the drive rim during the crawling operation, and separating the drive wheel from the drive rim when the paper machine is in the running operation.

3. The method of claim 2, further comprising connecting the drive wheel to a hydraulic cylinder in the hydraulic device and displacing the cylinder into contact with the drive rim by directing hydraulic pressure into the cylinder.

4. The method of claim 3, further comprising arranging a spring in the hydraulic device causing the drive wheel to be displaced away from the drive rim during the running operation of the felt when the drive roll is moving.

5. The method of claim 1, further comprising moistening the felt when the drive roll is moving.

6. The method of claim 1, further comprising operating a nip drive between the center roll and the press roll during the running operation of the paper machine.

7. The method of claim 1, further comprising arranging a drive unit inside the drive rim, providing the drive unit with a plurality of cylinders, arranging a drive piston and cam-wheel in each of the cylinders, displacing the drive pistons toward the drive rim alternatingly such that a force acts upon the drive rim and the drive rim revolves during the crawling operation, and arranging springs in the drive unit to keep the drive pistons in a position where they do not contact the drive rim when the paper machine is in the running operation.

* * * * *